US011022372B2

(12) United States Patent
Tada et al.

(10) Patent No.: US 11,022,372 B2
(45) Date of Patent: Jun. 1, 2021

(54) AIR CONDITIONER

(71) Applicant: Hitachi-Johnson Controls Air Conditioning, Inc., Tokyo (JP)

(72) Inventors: Shuuhei Tada, Tokyo (JP); Kenji Matsumura, Tokyo (JP); Nagatoshi Ooki, Tokyo (JP); Mamoru Houfuku, Tokyo (JP); Takeshi Endo, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 188 days.

(21) Appl. No.: 16/019,618

(22) Filed: Jun. 27, 2018

(65) Prior Publication Data

US 2018/0306515 A1 Oct. 25, 2018

Related U.S. Application Data

(63) Continuation-in-part of application No. PCT/JP2017/043016, filed on Nov. 30, 2017.

(30) Foreign Application Priority Data

Jan. 13, 2017 (JP) ..... JP2017-004542

(51) Int. Cl.
*F28D 1/053* (2006.01)
*F28F 1/02* (2006.01)
(Continued)

(52) U.S. Cl.
CPC ..... *F28D 1/05383* (2013.01); *F25B 39/00* (2013.01); *F28D 1/0417* (2013.01);
(Continued)

(58) Field of Classification Search
CPC ..... F28D 1/05366; F28D 1/05375; F28D 1/05383; F28F 1/022; F28F 9/028; F28F 9/027
See application file for complete search history.

(56) References Cited

U.S. PATENT DOCUMENTS 5,203,407 A * 4/1993 Nagasaka ..... F28D 1/05375 165/174
5,752,566 A * 5/1998 Liu ..... F28F 9/028 165/110
(Continued)

FOREIGN PATENT DOCUMENTS

JP 2001-304621 A 10/2001
JP 2007-163013 A 6/2007
(Continued)

OTHER PUBLICATIONS

International Search Report and Written Opinion of PCT/JP2017/043016 dated Feb. 20, 2018.

*Primary Examiner* — Eric S Ruppert
(74) *Attorney, Agent, or Firm* — Mattingly & Malur, PC

(57) ABSTRACT

An air conditioner that includes a heat exchanger including: heat-transfer pipes extending in a horizontal direction and spaced apart at predetermined intervals in a vertical direction and configured to allow a thermal medium to flow therein. A part of the heat transfer pipes are used for at least one inflow path into which the thermal medium flows from the outside of the heat exchanger and the other part of the heat transfer pipes are used for at least one outflow path from which the thermal medium flows out to the outside. At least one connection pipe through which an outlet side of one of the at least one inflow path communicates with an inlet side of one of the at least one outflow path.

8 Claims, 10 Drawing Sheets

(51) Int. Cl.

| | |
|---|---|
| ***F28F 1/42*** | (2006.01) |
| ***F28F 9/02*** | (2006.01) |
| ***F25B 39/00*** | (2006.01) |
| ***F28D 1/04*** | (2006.01) |
| ***F28F 1/32*** | (2006.01) |
| *F28F 1/04* | (2006.01) |
| *F28F 23/00* | (2006.01) |
| *F28D 1/02* | (2006.01) |
| *F24F 13/30* | (2006.01) |
| *F24F 11/89* | (2018.01) |

(52) U.S. Cl.

CPC ..... *F28D 1/0535* (2013.01); *F28F 1/022* (2013.01); *F28F 1/32* (2013.01); *F28F 1/422* (2013.01); *F28F 9/027* (2013.01); *F28F 9/0243* (2013.01); *F28F 9/0253* (2013.01); *F28F 9/0265* (2013.01); *F24F 11/89* (2018.01); *F24F 13/30* (2013.01); *F28D 1/024* (2013.01); *F28F 1/04* (2013.01); *F28F 9/0209* (2013.01); *F28F 23/00* (2013.01)

(56) References Cited

U.S. PATENT DOCUMENTS

| | | | | |
|---|---|---|---|---|
| 5,988,267 | A * | 11/1999 | Park | F25B 39/04 165/110 |
| 2003/0141048 | A1* | 7/2003 | Lee | F28F 1/022 165/177 |
| 2008/0141709 | A1* | 6/2008 | Knight | F25B 39/028 62/498 |
| 2016/0320135 | A1* | 11/2016 | Inoue | F28F 9/22 |

FOREIGN PATENT DOCUMENTS

| | | | |
|---|---|---|---|
| JP | 2013-053812 | A | 3/2013 |
| JP | 2013-228154 | A | 11/2013 |
| JP | 2015-127619 | A | 7/2015 |
| JP | 2016-053473 | A | 4/2016 |
| JP | 2016053473 | A * | 4/2016 |

* cited by examiner

AIR CONDITIONER

CROSS-REFERENCE TO RELATED APPLICATIONS

This application is a continuation-in-part application of PCT/JP2017/043016, filed on Nov. 30, 2017, which claims priority to Japanese Patent Application No. 2017-004542, filed on Jan. 13, 2017, the contents of which are hereby incorporated by reference in their entireties.

BACKGROUND

1. Field of the Invention

The present invention relates to an air conditioner having a heat exchanger.

2. Description of Related Art

Various proposals have been made for improving heat-exchange efficiency of heat exchangers of air conditioners.

For example, Japanese Patent Application Publication No. 2013-53812 presents proposals related to a heat exchanger in which a plurality of heat-transfer pipes extending in a horizontal direction are disposed at predetermined intervals in a vertical direction and header pipes extending in the vertical direction are provided at opposite ends of the plurality of heat transfer pipes. The interior of each header pipe is divided into a plurality of sections by partition plates. Refrigerant circulating in the heat exchanger flows downward while flowing through the heat-transfer pipes in both directions between the header tubes. Corrugated fins are interposed between the heat-transfer pipes. The refrigerant transfers heat to/from (exchanges heat with) an air flow passing the corrugated fins while the refrigerant passes through the heat-transfer pipes.

When the heat exchanger described above is used as a condenser, refrigerant in a gaseous state (gas refrigerant) gives off heat to an air flow (i.e., the refrigerant is cooled by the air flow) to condense into refrigerant in a liquid state (liquid refrigerant).

As the volume of the liquid refrigerant does not further diminish even when it is cooled, a liquid pool of the liquid refrigerant is formed in the heat-transfer pipes to narrow the region in which the gas refrigerant can give off heat to condense, resulting in a decrease in the heat-exchange efficiency. In view of the above, it is desirable to inhibit formation of the liquid pool of the liquid refrigerant.

As to the amount of refrigerant to be sealed, an insufficient amount of refrigerant cannot demonstrate desired heat exchange performance, whereas an excessive amount of refrigerant increases production costs.

Moreover, taking into account the Global Warming Potential (GWP) of the refrigerant to be used, it is desirable to avoid unnecessarily increasing the amount of refrigerant to be sealed.

The present invention has been made in view of the above circumstances and it is an object of the present invention to provide an air conditioner that can inhibit formation of a liquid pool in a heat exchanger to improve the heat-exchange efficiency and allow sealing an appropriate amount of refrigerant into the heat exchanger.

SUMMARY

To achieve the above-described object, an air conditioner according to the present invention includes a heat exchanger that includes: a plurality of heat-transfer pipes arranged to extend in a horizontal direction and to be spaced apart at predetermined intervals in a vertical direction and configured to allow a thermal medium to flow therein, wherein a part of the plurality of heat transfer pipes are used for at least one inflow path into which the thermal medium flows from an outside of the heat exchanger and the other part of the plurality of heat transfer pipes are used for at least one outflow path from which the thermal medium flows out to the outside of the heat exchanger; and at least one connection pipe through which an outlet side of one of the at least one inflow path communicates with an inlet side of one of the at least one outflow path, the at least one connection pipe having a hydraulic diameter of 4 mm or greater. A circulation flow rate Gr kg/s of the thermal medium and the number of the paths N satisfy $0.003 \leq Gr/N \leq 0.035$.

Advantageous Effects of the Invention

The present invention provides an air conditioner that can inhibit formation of a liquid pool in a heat exchanger to allow for sealing an appropriate amount of refrigerant into the heat exchanger while improving the heat-exchange efficiency.

EMBODIMENTS FOR CARRYING OUT THE INVENTION

Embodiments for carrying out the present invention will now be described in detail with reference to the drawings. In the description, the same symbols will be assigned to the respective same elements, and duplicative description will be omitted.

<Configuration of Air Conditioner>

Figure 1:
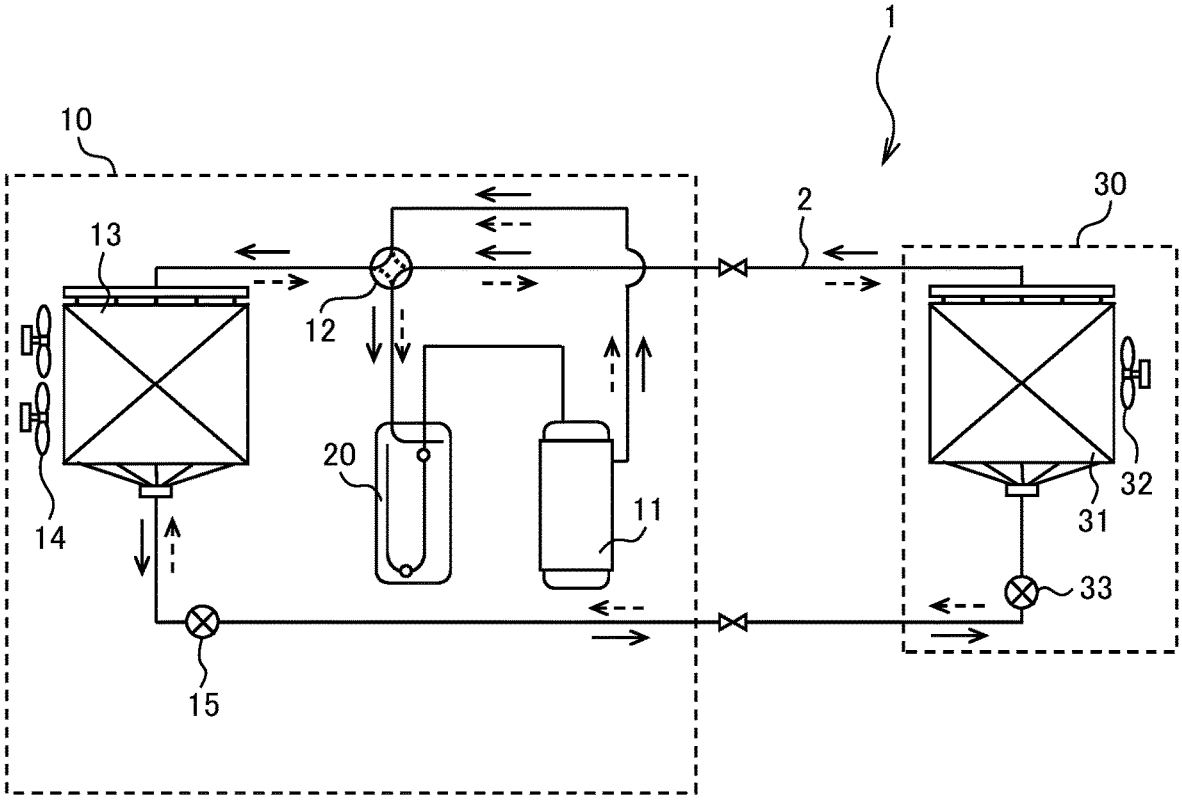
FIG. 1 is a diagram representing the refrigeration cycle system of an air conditioner according to a present embodiment.

FIG. 1 illustrates the refrigeration cycle of an air conditioner 1 in which the heat exchanger 101 according to the present invention is employed.

The air conditioner 1 has an outdoor unit 10 and an indoor unit 30.

The outdoor unit 10 has a compressor 11, a four-way valve 12, an outdoor heat exchanger 13, an outdoor blower 14, an outdoor expansion valve 15, and an accumulator 20.

The indoor unit 30 has an indoor heat exchanger 31, an indoor blower 32, and an indoor expansion valve 33.

The devices of the outdoor unit 10 and the devices of the indoor unit 30 are connected by a refrigerant piping 2 to form a refrigeration cycle. Refrigerant serving as a thermal medium is sealed in the refrigerant piping 2. The refrigerant circulates between the outdoor unit 10 and the indoor unit 30 via the refrigerant piping 2.

Next, a description will be given of the devices of the outdoor unit 10.

The compressor 11 sucks and compresses refrigerant in a gaseous state (gas refrigerant) and discharges the compressed refrigerant.

The four-way valve 12 changes the direction of refrigerant flowing between the outdoor unit 10 and the indoor unit 30 while maintaining the direction of refrigerant flowing toward the compressor 11. The four-way valve 12 switches between cooling and heating operations by changing the direction of the refrigerant.

The outdoor heat exchanger 13 has a heat exchanger 101 according to the present invention to exchange heat between the refrigerant and outdoor air.

The outdoor blower 14 supplies the outdoor air to the outdoor heat exchanger 13.

The outdoor expansion valve 15 is a throttle valve for causing refrigerant in a liquid state (liquid refrigerant) to evaporate by adiabatic expansion.

The accumulator 20 is provided to accumulate liquid return in a transitional state. The accumulator 20 separates liquid refrigerant mixed in gas refrigerant to be supplied to the compressor 11 to maintain a moderate quality of the refrigerant.

Next, a description will be given of the devices of the indoor unit 30.

The indoor heat exchanger 31 has a heat exchanger 101 according to the present invention to exchange heat between refrigerant and indoor air.

The indoor blower 32 supplies the indoor air to the indoor heat exchanger 31.

The indoor expansion valve 33 is a throttle valve for causing refrigerant in a liquid state (liquid refrigerant) to evaporate by adiabatic expansion. The indoor expansion valve 33 is capable of changing the aperture size thereof to change the flow rate of refrigerant flowing in the indoor heat exchanger 31.

<Operation of Air Conditioner>

Next, a description will be given of a cooling operation of the air conditioner 1 by which cool air is supplied into a room.

The solid arrows in FIG. 1 represent the flow of refrigerant in the cooling operation. The four-way valve 12 controls the direction of the flow as indicated by the solid lines.

The gas refrigerant compressed to high-temperature and high-pressure by the compressor 11 flows into the outdoor heat exchanger 13 via the four-way valve 12.

The gas refrigerant that has flowed into the outdoor heat exchanger 13 gives off heat to the outdoor air supplied by the outdoor blower 14, to condense into a low-temperature, high-pressure liquid refrigerant.

That is, the outdoor heat exchanger 13 functions as a condenser in the cooling operation.

The liquid refrigerant that has condensed from the gas refrigerant is sent to the indoor unit 30 via the outdoor expansion valve 15. As the outdoor expansion valve 15 does not function as an expansion valve in this process, the liquid refrigerant passes through the outdoor expansion valve 15 as is without adiabatic expansion.

The liquid refrigerant that has flowed into the indoor unit 30 adiabatically expands in the indoor expansion valve 33 and flows into the indoor heat exchanger 31.

The liquid refrigerant takes latent heat of vaporization from the indoor air supplied by the indoor blower 32, to evaporate into a low-temperature, low-pressure gas refrigerant.

That is, the indoor heat exchanger 31 functions as an evaporator in the cooling operation.

The indoor air is relatively cooled by being deprived of latent heat of vaporization, resulting in cool air blowing into the room.

The gas refrigerant that has evaporated from the liquid refrigerant is sent to the outdoor unit 10.

The gas refrigerant that has returned to the outdoor unit 10 passes through the four-way valve 12 and flows into the accumulator 20.

The liquid refrigerant mixed in the gas refrigerant having flowed into the accumulator 20 is separated in the accumulator 20, adjusted to have a predetermined quality, and supplied to the compressor 11 to be compressed again.

In this way, the cooling operation for providing cool air indoors is achieved by circulating the refrigerant in the directions indicated by the solid arrows in the refrigeration cycle.

That is, in the cooling operation, the outdoor heat exchanger 13 functions as a condenser and the indoor heat exchanger 31 functions as an evaporator.

Next, a description will be given of a heating operation of the air conditioner 1 by which warm air is supplied into the room.

The dotted arrows in FIG. 1 represent the flow of refrigerant in a heating operation. The four-way valve 12 controls the direction of the flow as indicated by the dotted lines.

The gas refrigerant that has been compressed to high-temperature and high-pressure by the compressor 11 flows into the indoor unit 30 via the four-way valve 12.

The gas refrigerant that has flowed into the indoor heat exchanger 31 gives off heat to the indoor air supplied by the indoor blower 32 while passing through the indoor heat exchanger 31, to condense into a low-temperature, high-pressure liquid refrigerant.

That is, the indoor heat exchanger 31 functions as a condenser in the heating operation.

The indoor air is relatively heated by receiving heat, resulting in warm air blowing into the room.

The liquid refrigerant that has condensed from the gas refrigerant passes the indoor expansion valve 33 to be sent to the outdoor unit 10. As the indoor expansion valve 33 does not function as an expansion valve in this process, the liquid refrigerant passes through the indoor expansion valve 33 as is without adiabatic expansion.

The liquid refrigerant that has flowed into the outdoor unit 10 adiabatically expands in the outdoor expansion valve 15 and flows into the outdoor heat exchanger 13.

The liquid refrigerant takes latent heat of vaporization from the outdoor air supplied by the outdoor blower 14, to evaporate into a low-temperature, low-pressure gas refrigerant.

That is, the outdoor heat exchanger 13 functions as an evaporator in the heating operation.

The refrigerant that has flowed out of the outdoor heat exchanger 13 passes through the four-way valve 12 and flows into the accumulator 20.

The liquid refrigerant mixed in the refrigerant having flowed into the accumulator 20 is separated in the accumulator 20, adjusted to have a predetermined quality, and supplied to the compressor 11 to be compressed again.

In this way, a heating operation for providing warm air indoors is achieved by circulating the refrigerant in the directions indicated by the dotted arrows in the refrigeration cycle.

That is, in the heating operation, the indoor heat exchanger 31 functions as a condenser and the outdoor heat exchanger 13 functions as an evaporator.

Next, a description will be given of the heat exchanger 101 according to the present embodiment, which constitutes each of the above-described outdoor heat exchanger 13 and the indoor heat exchanger 31.

The outdoor heat exchanger 13 and the indoor heat exchanger 31 in the above described air conditioner 1 are each constituted by the heat exchanger 101 of the present invention. It should be noted that the heat exchanger 101 exerts effects of the present invention even when only one of the outdoor heat exchanger 13 and the indoor heat exchanger 31 is constituted by the heat exchanger 101.

Figure 2:
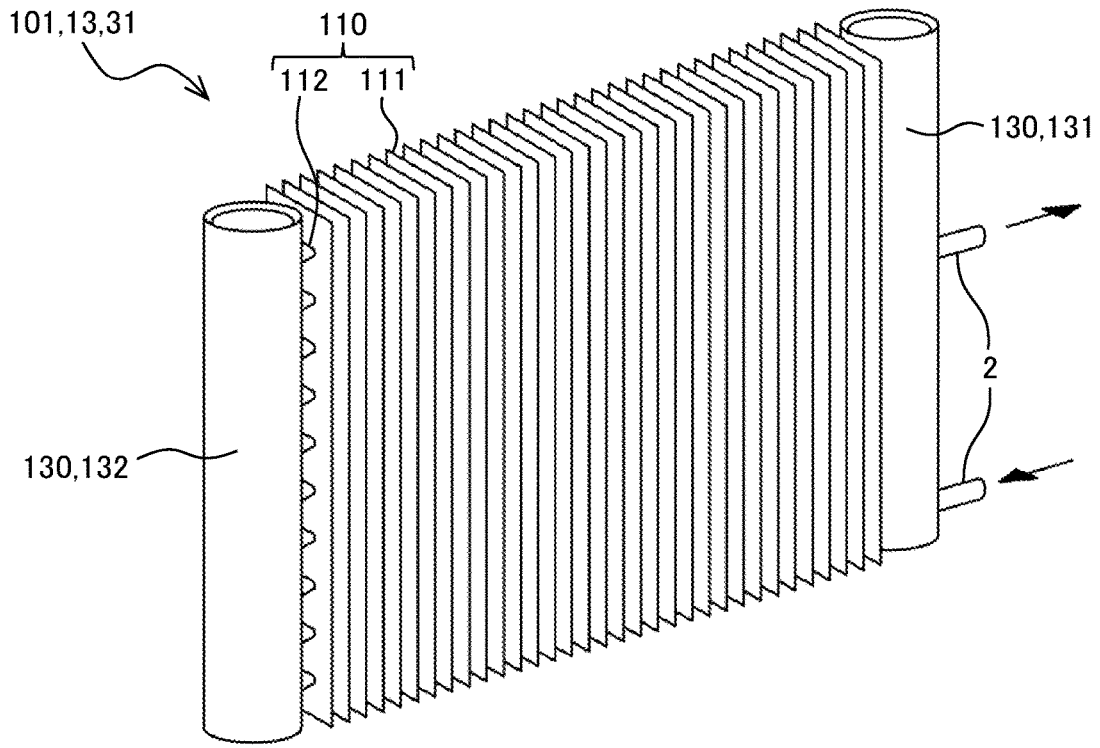
FIG. 2 is a perspective view showing a heat exchanger of the air conditioner according to the present embodiment.
Figure 3:
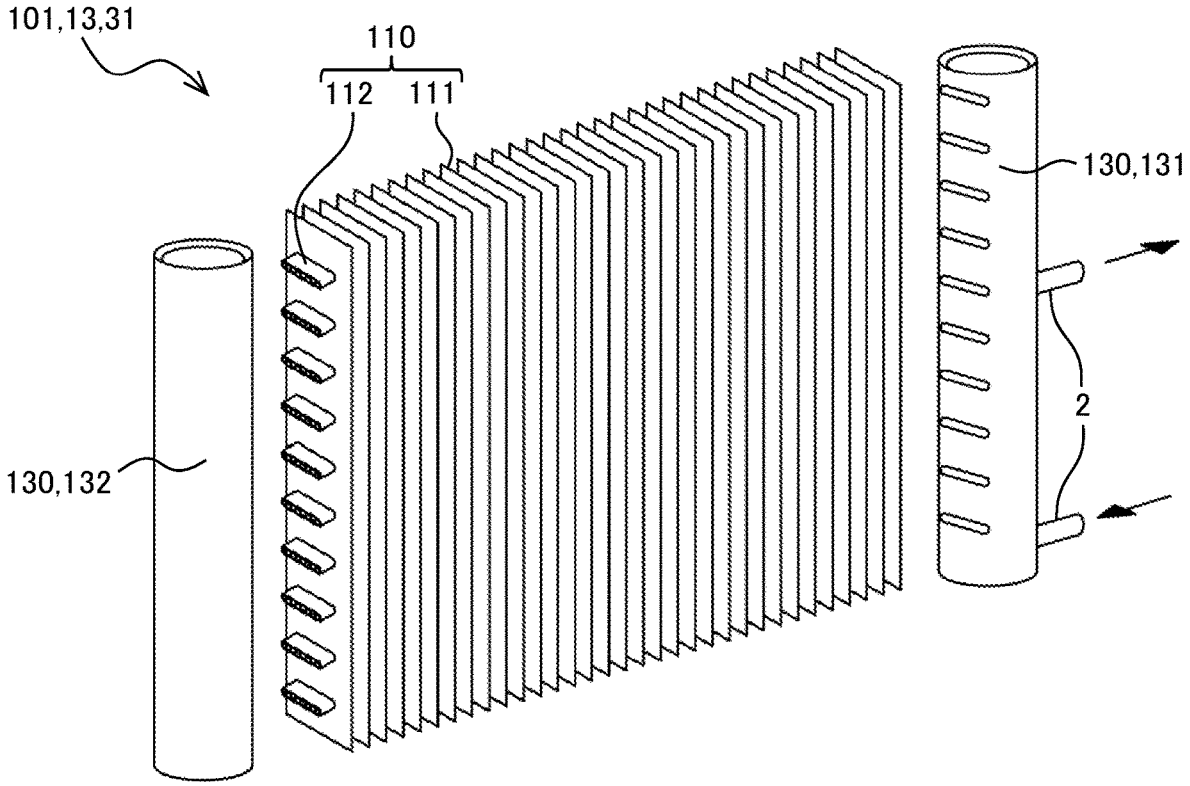
FIG. 3 is an exploded perspective view illustrating the heat exchanger disassembled into a heat exchange section and headers.

As shown in FIGS. 2 and 3, the heat exchanger 101 according to the present embodiment is a fin-tube type heat exchanger and has a heat exchange section 110 and headers 130.

The heat exchange section 110 is a part to exchange heat between refrigerant and air. The heat exchange section 110 has a plurality of heat-transfer fins 111 and a plurality of heat-transfer pipes 112 (see FIG. 3)

The plurality of heat-transfer fins 111 are each constituted by a rectangular, plate-shaped member. The plurality of heat-transfer fins 111 are arranged in a stacked manner such that the rectangular plate-shaped members have their length directions in the vertical direction and are spaced apart at predetermined intervals, with adjacent rectangular plate-shaped members facing with each other. The outdoor air or indoor air passes through gaps between the stacked heat-transfer fins 111.

Figure 4:
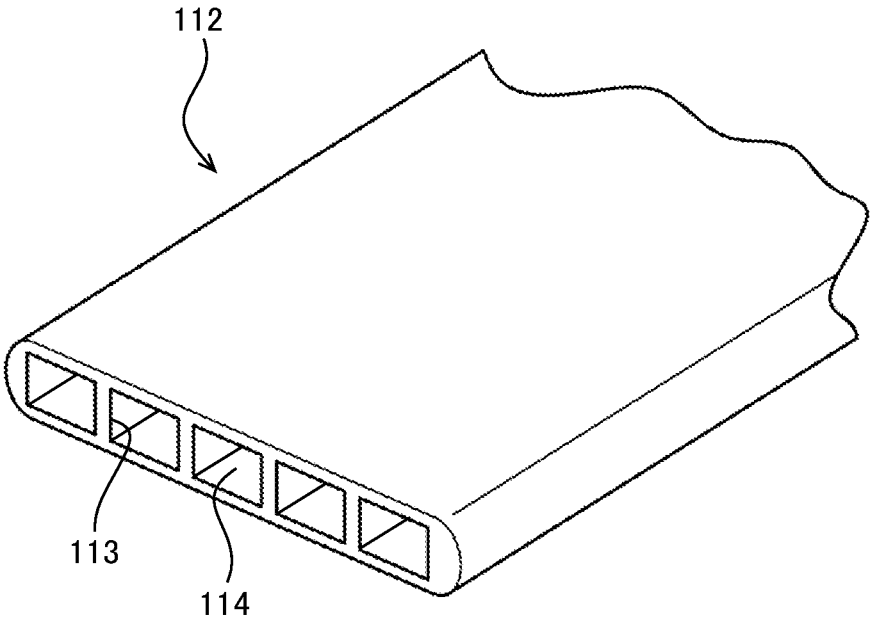
FIG. 4 is a perspective view of a heat-transfer pipe of the heat exchanger.

As shown in FIG. 4, each heat-transfer pipe 112 is constituted by a flat tubular member with a cross section having a substantially oval shape. The interior of the flat tubular member is divided by partition walls 113 into a plurality of flow channels 114 extending in the length direction of the flat tubular member. The heat-transfer pipes 112 have upper and lower portions that correspond to flat portions of the oval shape and extend in the horizontal direction, and are spaced apart at predetermined intervals in the vertical direction. The heat-transfer pipes 112 penetrate the stacked heat-transfer fins 111 and are joined thereto.

The heat-transfer pipes 112 each have opposite ends that communicate with respective headers 130.

In the use of the heat exchanger 101 as a condenser, the plurality of heat-transfer pipes 112 provide inflow paths 121 into which the refrigerant (gas refrigerant) flows from the outside and outflow paths 122 from which the refrigerant (liquid refrigerant) flows out to the outside.

Figure 5:
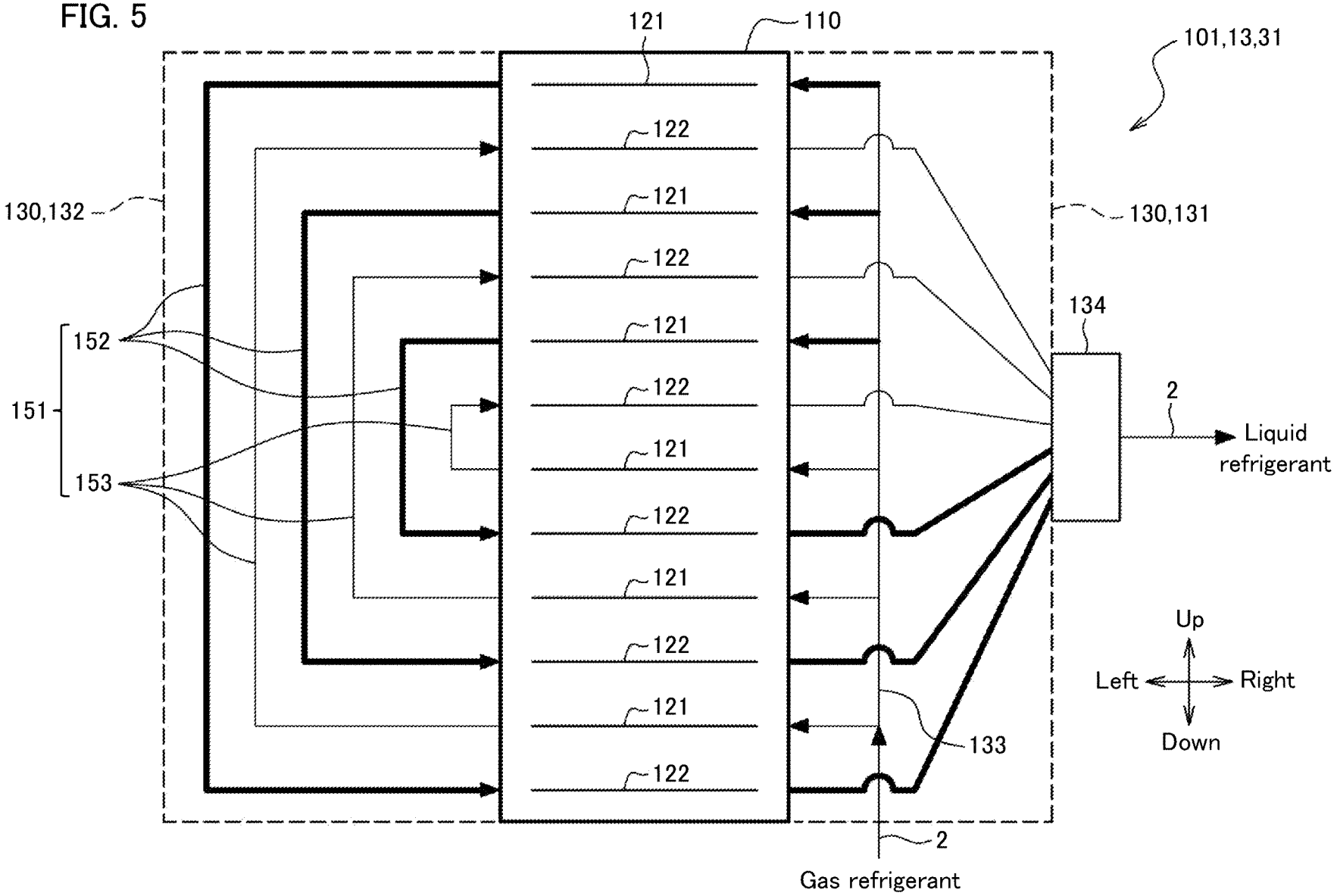
FIG. 5 is a schematic view illustrating the configuration of the heat exchanger according to the present embodiment.

As shown in FIG. 5, in the heat exchanger 101 according to the present embodiment, the inflow paths 121 and the outflow paths 122 are alternately arranged in the vertical direction. The inflow paths 121 and the outflow paths 122 are not necessarily alternately arranged in the vertical direction if they are arranged such that they are not likely to be influenced by the gravity.

Figure 6:
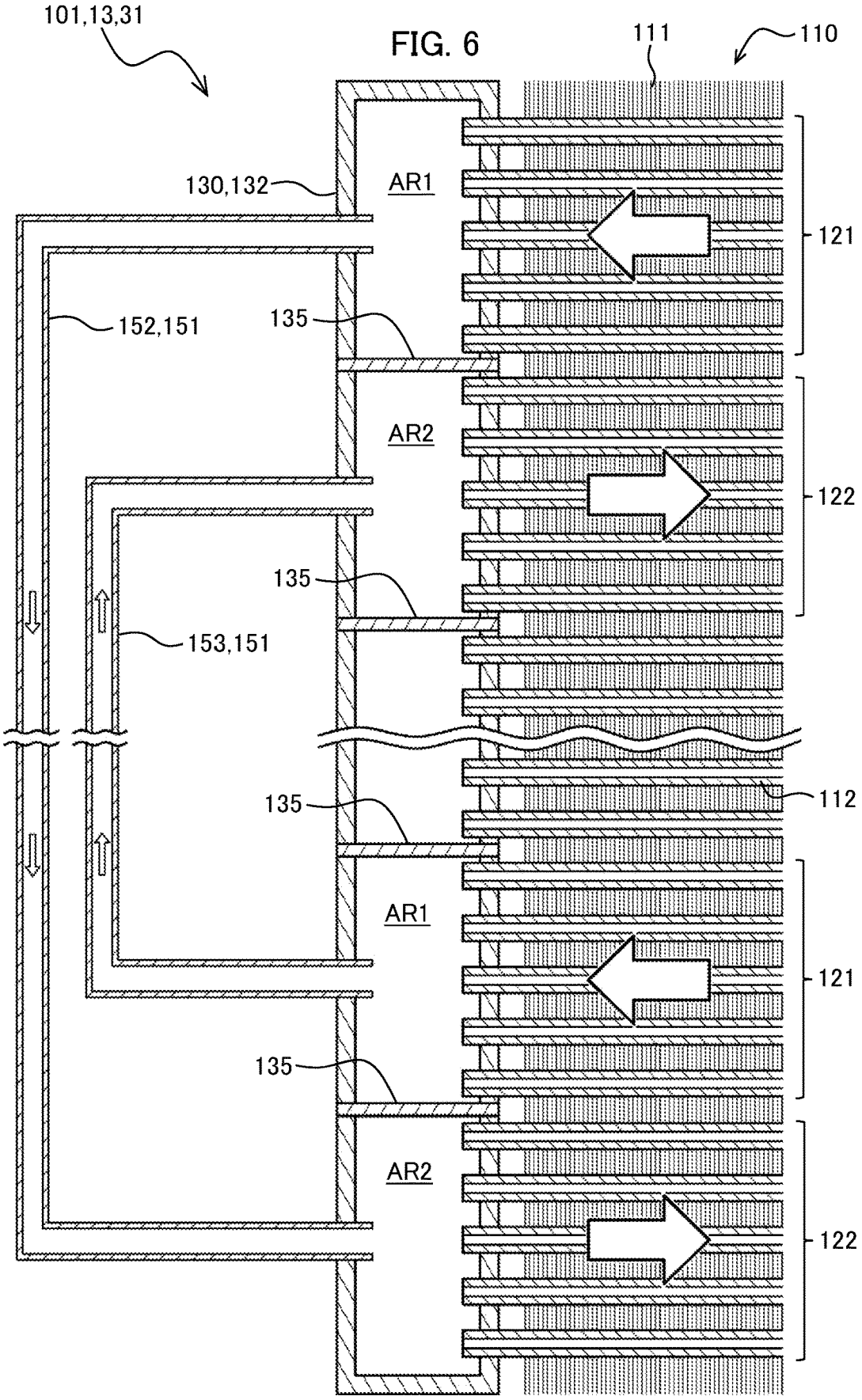
FIG. 6 is a cross-sectional view of a connection portion of the heat exchanger according to the present embodiment, which connection portion connects a fold back header of the heat exchanger to the heat exchange section of the heat exchanger.

In the condenser, the ratio of gas refrigerant to the whole refrigerant is high upstream of the heat exchange section 110, whereas the ratio of liquid refrigerant to the whole refrigerant increases as the refrigerant flows downstream. That means that the volume of the refrigerant in each outflow path 122 is smaller than that in the corresponding inflow path 121. In FIG. 6, for simplicity of drawing, each inflow path 121 and each outflow path 122 have the same number of heat-transfer pipes 112. However, it is desirable to select the number of heat-transfer pipes for each path so that refrigerant flows at a necessary speed in accordance with whether the refrigerant flowing through the path is in a condensed state or a vapor state.

The refrigerant that has flowed out of inflow paths is in a gas-liquid two-phase state, in which the refrigerant has not completely condensed. By making the refrigerant that has flowed out of the inflow paths flow into connection pipes 151 and flow downward or upward in the connection pipes 151, influences of gravity on the refrigerant between the paths can be reduced and formation of a liquid pool at lower paths can be inhibited.

As shown in FIGS. 5 and 6, the headers 130 are constituted by a distribution/collection header 131 and a fold back header 132 that bundle the heat-transfer pipes 112 at opposite ends thereof. The distribution/collection header 131 distributes/collects refrigerant to/from the heat-transfer pipes 112.

The distribution/collection header 131 includes a part called distribution section 133 that distributes refrigerant flowing from the outside into the distribution/collection header 131 to the inflow paths 121 when the heat exchanger 101 is used as a condenser. The distribution/collection header 131 further includes a part called collection section 134 that collects the refrigerant flowing out of the outflow paths 122 and discharges the refrigerant to the outside when the heat exchanger 101 is used as a condenser.

As shown in FIG. 6, the interior of the fold back header 132 is divided by partition plates 135 into compartments each of which is assigned to respective one of the inflow paths 121 and the outflow paths 122. The fold back header 132 is provided with the connection pipes 151. The interior of the distribution section 133 is divided by the partition plates 135 into compartments each of which is assigned to respective one of the inflow paths 121 in a similar manner to the fold back header 132. The interior of the collection section 134 is divided by the partition plates 135 into compartments each of which is assigned to respective one of the outflow paths 122 in a similar manner to the fold back header 132.

As shown in FIGS. 5 and 6, the connection pipes 151 are constituted by down-flow pipes 152 and up-flow pipes 153. The down-flow pipes 152 and the up-flow pipes 153 have the same cross section. In FIGS. 2 and 3, illustration of the connection pipes 151 is omitted for convenience of drawing.

Each down-flow pipe 152 allows, in the fold back header 132, the compartment on the outlet side of a corresponding inflow path 121 (outlet-side compartment AR1 of the corresponding inflow path 121) to communicate with the compartment on the inlet side of a corresponding outflow path 122 (inlet-side compartment AR2 of the corresponding outflow path 122) located below the corresponding inflow path 121, via the down-flow pipe 152.

Each up-flow pipe 153 allows the outlet-side compartment AR1 of a corresponding inflow path 121 to communicate with the inlet-side compartment AR2 of a corresponding outflow path 122 located above the corresponding inflow path 121, via the up-flow pipe 153.

In the present embodiment, the uppermost inflow path 121 communicates with the lowermost outflow path 122 via one of the down-flow pipes 152. The lowermost inflow path 121 communicates with the uppermost outflow path 122 via one of the up-flow pipes 153.

The second uppermost inflow path 121 communicates with the second lowermost outflow path 122 via one of the down-flow pipes 152. The second lowermost inflow path 121 communicates with the second uppermost outflow path 122 via one of the up-flow pipes 153.

When the heat exchanger 101 is used as a condenser, the high-temperature, high-pressure gas refrigerant introduced into the distribution section 133 of the distribution/collection header 131 condenses into gas-liquid two-phase refrigerant, which is a mixture of gas refrigerant and liquid refrigerant, by exchanging heat with air while passing through the inflow paths 121. The gas-liquid two-phase refrigerant is introduced from the outlet-side compartments AR1 of the inflow paths 121 in the fold back header 132 into the inlet-side compartments AR2 of the outflow paths 122 in the fold back header 132, via the down-flow pipes 152 or the up-flow pipes 153. The gas-liquid two-phase refrigerant in the inlet-side compartments AR2 of the outflow paths 122 condenses further into gas-liquid two-phase refrigerant in which liquid refrigerant is dominant, by exchanging heat with air when passing through the outflow paths 122.

The pressure of refrigerant flowing downward in the down-flow pipes 152 increases as the refrigerant moves from the outlet-side compartments AR1 of the inflow paths 121 to the inlet-side compartments AR2 of the outflow paths 122. This partially cancels a decrease in the pressure of refrigerant flowing upward in the up-flow pipes 153, resulting in a decrease in the pressure difference Δp due to influences of gravity.

As a result, the pressure difference Δp in the vertical direction in the heat exchange section 110 is decreased, inhibiting formation of a liquid pool of refrigerant in lower heat-transfer pipes 112. This allows for exchanging heat with high-efficiency.

Next, a description will be given of the flow rate of refrigerant circulating in the air conditioner 1.

Hereinafter, the amount of refrigerant circulating per second when the air conditioner 1 is in operation at a rated cooling capacity of the air conditioner 1 is referred to as refrigerant circulation flow rate Gr [kg/s], and the number of inflow paths 121 to which the distribution/collection header 131 distributes the refrigerant, i.e., the number of branches of the distribution section 133, is referred to as the number of paths N. The number of paths N is equal to the number of outflow paths 122 and the number of connection pipes 151. The rated cooling capacity of the air conditioner 1 refers to an output of the air conditioner 1 when room air is cooled to a temperature of 27° C., under the condition where a temperature of outdoor air is 35° C. and a relative humidity of the room air is 45%.

Figure 7:
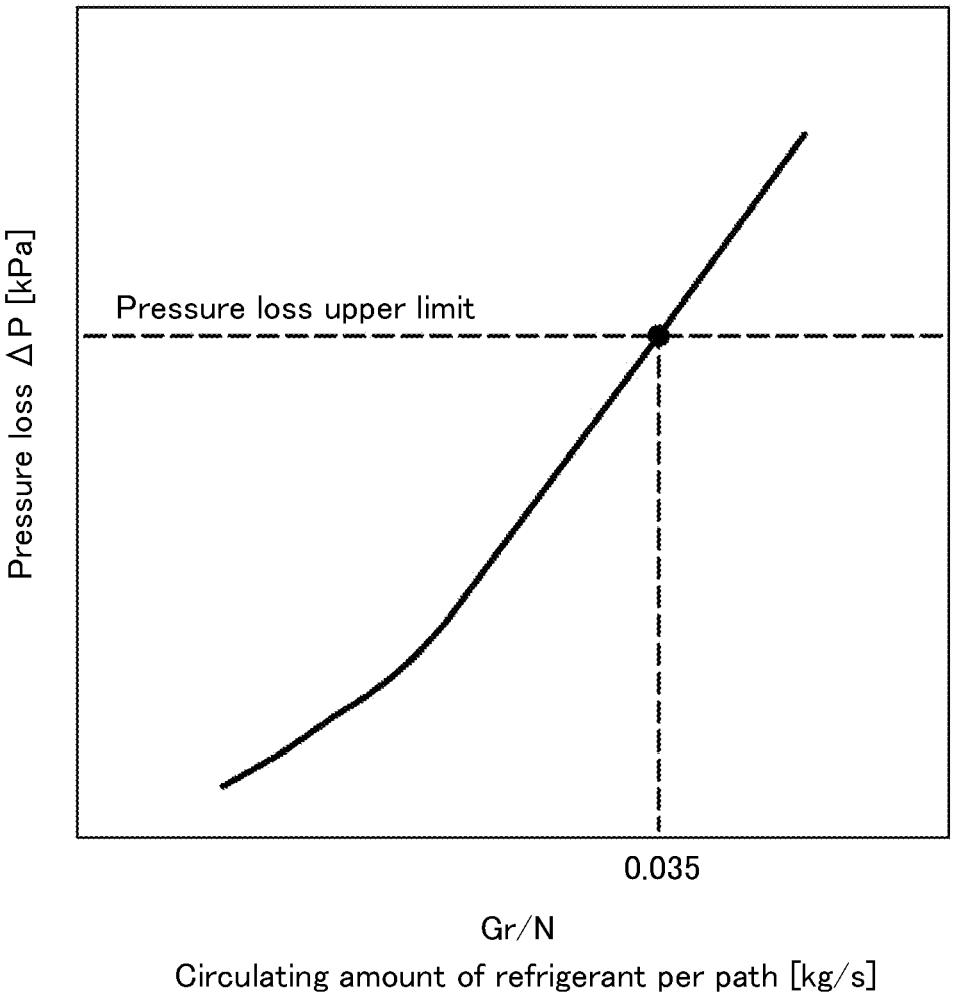
FIG. 7 is a graph illustrating the relationship between the circulation flow rate of refrigerant per path and the pressure loss.

FIG. 7 is a graph illustrating the relationship between the refrigerant circulation flow rate per path (flow channel) Gr/N [kg/s] and the pressure loss ΔP [kPa] in the connection pipes 151.

FIG. 7 shows that as the refrigerant circulation flow rate per path Gr/N [kg/s] increases, the pressure loss ΔP [kPa] increases.

The pressure loss ΔP [kPa] of the heat exchanger 101 is derived from the pressure loss in the heat-transfer pipes 112 and the pressure loss in the connection pipes 151.

It is required that the pressure loss in the connection pipes 151 be inhibited to such a degree that the power consumption of the air conditioner 1 is not increased. This is because the connection pipes 151 are not portions for exchanging heat between the refrigerant and air positively.

From calculations, it is derived that the refrigerant circulation flow rate per path Gr/N [kg/s] is preferably less than or equal to 0.035.

In other words, influences of pressure loss by the connection pipes 151 can be inhibited by setting the refrigerant circulation flow rate Gr of the air conditioner and the number of paths N so as to satisfy Inequality 1.

$$N \geq Gr/0.035 \qquad \text{Inequality 1}$$

As described above, the connection pipes 151 are constituted by the up-flow pipes 153 and down-flow pipes 152. The refrigerant flowing through the connection pipes 151 is being condensed and thus is in the form of gas-liquid two-phase refrigerant, which is a mixture of gas refrigerant and liquid refrigerant. A certain flow rate is necessary for the gas-liquid two-phase refrigerant including liquid refrigerant mixed therein to flow upward in the up-flow pipes 153, to move into the inlet-side compartments AR2 of the outflow paths 122 located on the upper side. Thus, the flow rate of the refrigerant will be discussed next.

The Froude number Fr is known as an index for estimating a rising limit of a liquid. The Froude number Fr is calculated by Equation 2:

$$Fr=(\rho G \cdot uG2+\rho L \cdot uG2)/(\rho L \cdot g \cdot d) \qquad \text{Equation 2}$$

where ρL is the density of the liquid refrigerant, ρG is the density of the gas refrigerant, uG is the flow rate of the gas refrigerant, g is the gravitational acceleration, and d is the inner diameter of the pipe.

By setting the flow rate of gas-liquid two-phase refrigerant such that the Froude number Fr takes a value greater than or equal to a predetermined value (=1), the gas-liquid two-phase refrigerant including liquid refrigerant mixed therein is able to flow upward in the up-flow pipes 153.

When the Froude number Fr is less than the predetermined value (=1), the mixed liquid refrigerant adheres to the wall surfaces of the up-flow pipes 153 and is unable to flow upward further. As a result, liquid pools are formed in the outlet-side compartments AR1 of the inflow paths 121 located on the lower side.

Figure 8:
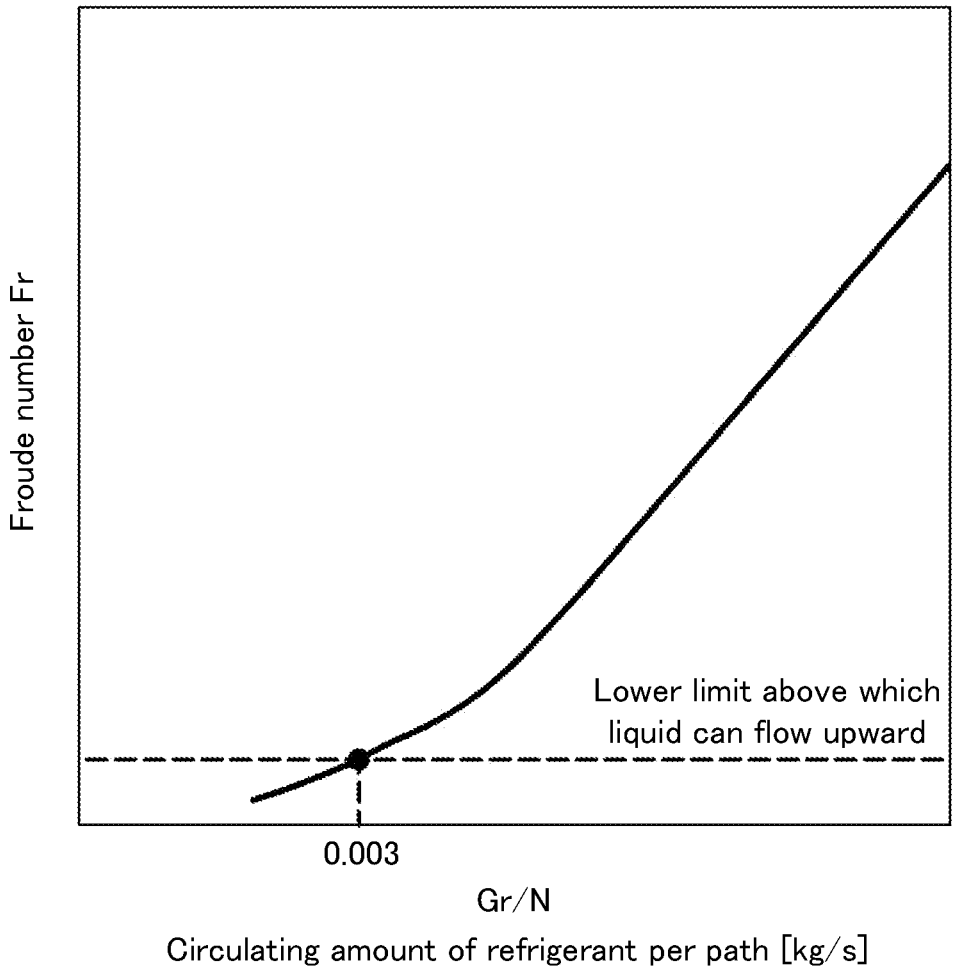
FIG. 8 is a graph illustrating the relationship between the circulation flow rate of refrigerant per path and the Froude number.

To obtain a Froude number Fr of a predetermined value (=1) or greater, it is necessary that the refrigerant circulation flow rate per path Gr/N [Kg/s] be greater than or equal to 0.003 [kg/s] (see FIG. 8).

Therefore, in combination with the conditions described above, it is required to determine the number of paths N with respect to the refrigerant circulation flow rate Gr such that the refrigerant circulation flow rate per path Gr/N [Kg/s] satisfies Inequality 3.

This inhibits the pressure loss ΔP [kPa] due to the arrangement of connection pipes 151 and inhibits formation of liquid pools in the connection pipes 151.

$$0.003 \leq Gr/N \leq 0.035 \text{ [kg/s]} \quad \text{Inequality 3}$$

Next, a description will be given of the configuration of the connection pipes 151.

The connection pipes 151 are not limited as to their cross sectional shape, but are configured as having their hydraulic diameter D in the range given by Inequality 4.

$$4 \leq D \leq 11 \text{ [mm]} \quad \text{Inequality 4}$$

Figure 9:
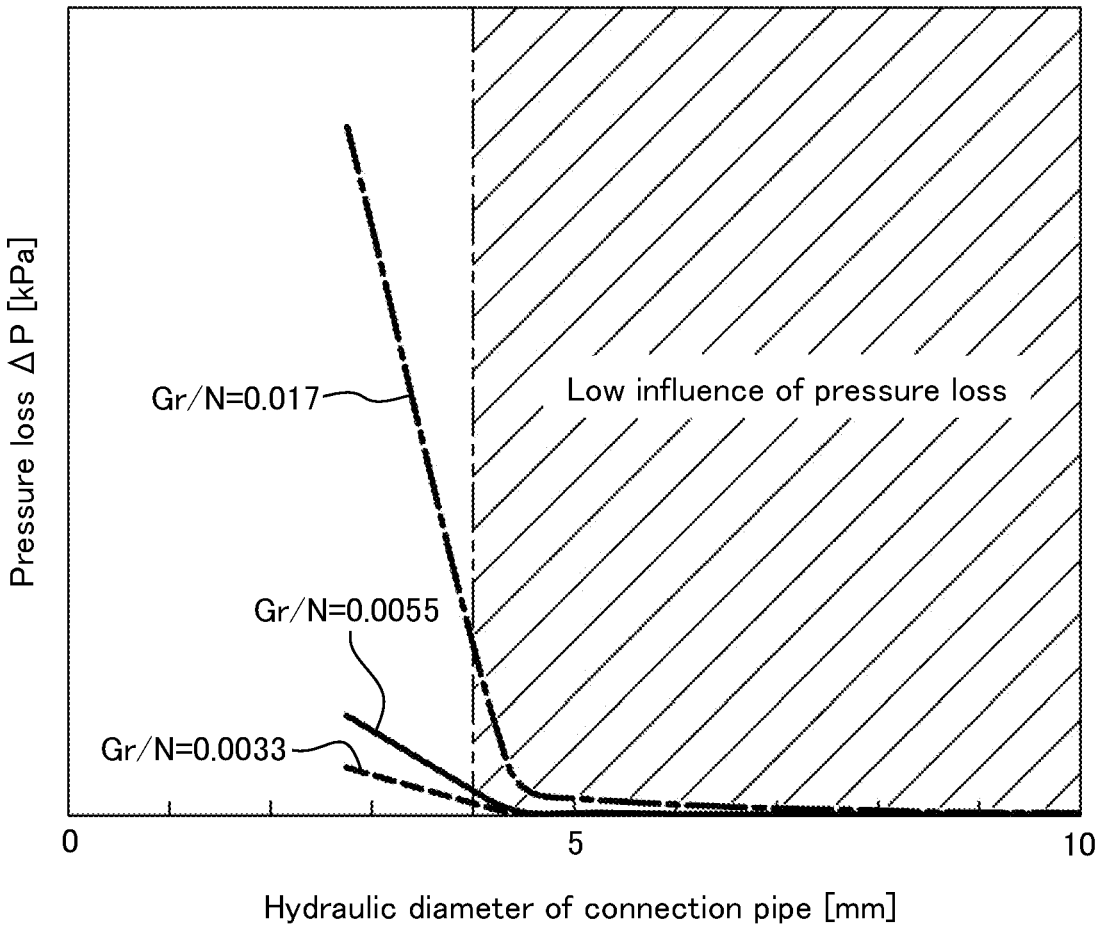
FIG. 9 is a graph illustrating the relationship between the hydraulic diameter and the pressure loss of a connection pipe.
Figure 10:
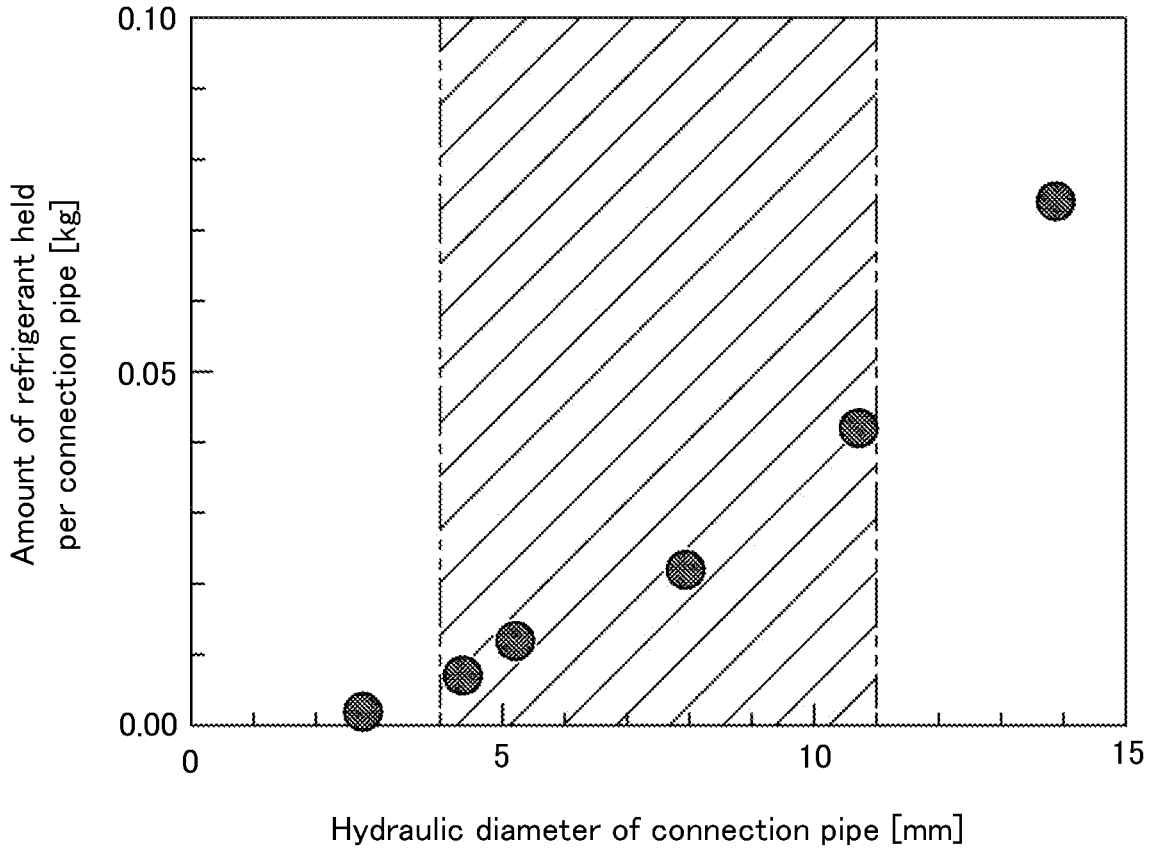
FIG. 10 is a diagram illustrating the relationship between the hydraulic diameter of a connection pipe and the amount of refrigerant holding capacity per path.

The range of hydraulic diameter D represented by Inequality 4 is derived from FIGS. 9 and 10.

FIG. 9 shows the relationship between the hydraulic diameter D [mm] of the connection pipes 151 and the pressure loss ΔP [kPa] in the connection pipes 151, in three conditions that satisfy Inequality 3.

From FIG. 9, it is obvious that, in a region where the hydraulic diameter D is less than a certain value, as the refrigerant circulation flow rate Gr increases, the pressure loss ΔP [kPa] increases. From FIG. 9, to reduce the influence of the pressure loss ΔP [kPa] for any refrigerant circulation flow rate Gr and the number of paths N, it is preferable that the hydraulic diameter D of the connection pipes 151 be 4 mm or greater.

Incidentally, when the connection pipes 151 have a larger hydraulic diameter D, radius for bending the connection pipes 151 needs to be increased. As a result, a larger space is required for installing the heat exchanger 101. However, the space for installing the heat exchanger 101 is limited. Thus, it is desirable that the heat exchanger 101 be as small as possible.

In addition, from FIG. 10, it is obvious that as the hydraulic diameter D of the connection pipes 151 increases, the amount of refrigerant held per connection pipe increases. An increase in the amount of refrigerant held increases production cost of the air conditioner 1 as a whole. For this reason, it is desirable not to hold more than necessary refrigerant.

For this reason, taking into account the installation of heat exchanger 101 in a machine casing (not shown) or the like of the outdoor unit 10, it is preferable to select pipes having a hydraulic diameter D of 11 mm or less as the connection pipes 151.

In view of the foregoing, the connection pipes 151 are configured such that the hydraulic diameter D thereof falls within the range given by Inequality 4.

Next, a description will be given of the effects of the heat exchanger 101 according to the present embodiment.

In the heat exchanger 101 according to the present embodiment, the inflow paths 121 and the outflow paths 122 are connected via the connection pipes 151 such that at least one of the inflow paths 121 communicates with one of the outflow paths 122 located below the at least one of the inflow paths 121, and at least another one of the inflow paths 121 communicates with another one of the outflow paths 122 located above the at least another one of the inflow paths 121.

With this configuration, an increase in the pressure of refrigerant flowing downward in the down-flow pipes 152 cancels at least some of the decrease in the pressure of refrigerant flowing upward in the up-flow pipes 153, resulting in a decrease in the pressure difference Δp due to influences of gravity.

As a result, the pressure difference Δp in the vertical direction in the heat exchange section 110 is decreased, inhibiting formation of liquid pools of refrigerant in the heat-transfer pipes 112 located on the lower side. This allows for exchanging heat with high-efficiency.

In the heat exchanger 101 according to the present embodiment, the refrigerant circulation flow rate per path Gr/N [Kg/s] is adjusted so as to fall within the range given by Inequality 3.

This inhibits formation of liquid pools in the heat-transfer pipes 112 and allows for exchanging heat (condensation of thermal medium) with high-efficiency.

In the heat exchanger 101 according to the present embodiment, the connection pipes 151 are configured to have a hydraulic diameter D falling within the range given by Inequality 4.

Selecting a hydraulic diameter D of 4 mm or greater reduces influence of the pressure loss of the refrigerant flowing through the connection pipes 151.

Selecting a hydraulic diameter D of 11 mm or smaller contributes to space saving of the device as a whole. Further, configuring the connection pipes 151 to have a hydraulic diameter D of 11 mm or smaller inhibits the amount of thermal medium held in the connection pipes 151, leading to cost reduction of the device as a whole.

In the heat exchanger 101 according to the present embodiment, each heat-transfer pipe 112 is constituted by a flat tubular member with a cross section having a substantially oval shape.

With this structure, each heat-transfer pipe 112 can have a smaller cross-sectional area than a circular cylindrical pipe having the same surface area, and thus can reduce the amount of the thermal medium to be held, even with the same surface area (heat exchange area) as that of the circular cylindrical pipe.

In addition, the interior of each heat-transfer pipe 112 is divided into the plurality of flow channels 114 by the partition walls 113 to increase the area where the thermal medium and the heat-transfer pipe 112 are in contact with each other.

This increases the amount of heat to be exchanged without increasing the amount of the thermal medium to be held.

In the heat exchanger 101 according to the present embodiment, it is preferable to use at least one of the refrigerants: R410A, R404A, R32, R1234yf, R1234ze(E), and HFO1123 as the thermal medium.

These refrigerants have an ozone depletion potential of zero. Selecting at least one of those refrigerants on the basis of the necessary refrigeration capacity and operation temperature allows for ensuring refrigeration capacity at any evaporation pressure. As a result, the embodiment allows for reducing the amount of the refrigerant to be held compared to that in conventional heat exchangers.

It should be noted that, in the present embodiment, although the configuration of the invention of the present application is applied to a fin-tube type heat exchanger, the invention of the present application is not limited thereto. The invention of the present application is applicable to any heat exchanger in which a plurality of heat-transfer pipes extending in the horizontal direction and spaced apart at predetermined intervals in the vertical direction are arranged and the plurality of heat-transfer pipes are used (assigned) as a plurality of paths via headers. Examples of such a heat exchanger include corrugated fin type heat exchangers. The invention of the present application applied to such a heat exchanger is able to achieve the same effects.

Although, in the present embodiment, the connection pipes 151 are arranged such as to be exposed outside the fold back header 132, the present application is not limited thereto.

Figure 11:
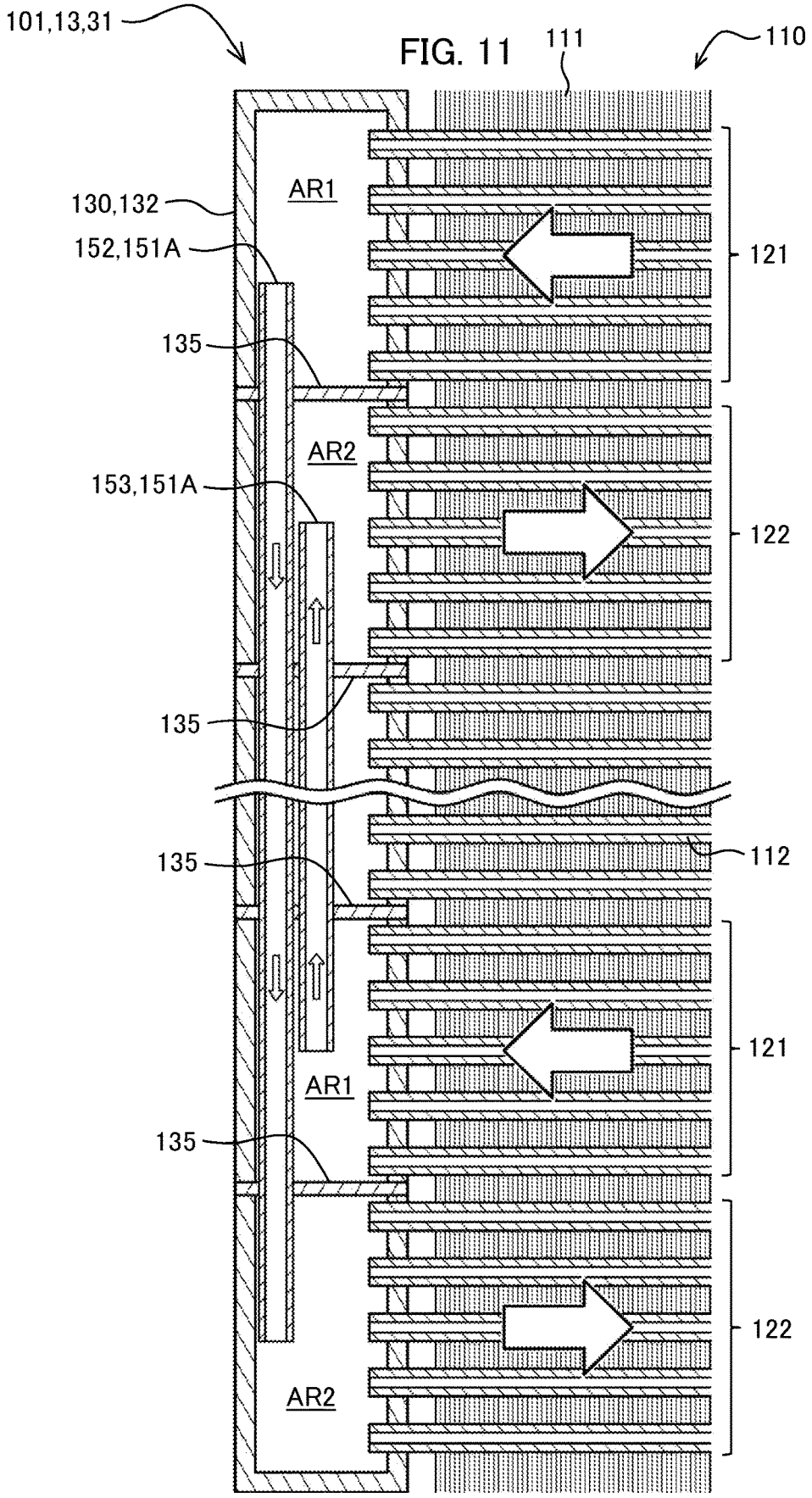
FIG. 11 is a cross-sectional view of another configuration for the connection portion connecting the fold back header and the heat exchange section of the heat exchanger according to the present embodiment.

For example, as shown in FIG. 11, connection pipes 151A can be arranged inside the fold back header 132.

With this configuration, as the fold back header 132 has no irregularity on the external side, the heat exchangers 101 are easily arranged in casings of the outdoor unit 10 and the indoor unit 30.

In the present embodiment, the number of heat-transfer pipes 112 constituting each inflow path 121 is the same as the number of heat-transfer pipes 112 constituting each outflow path 122. However, the present invention is not limited thereto. It is possible to assign different number of heat-transfer pipes 112 to them.

For example, as described above, in a condenser, the ratio of gas refrigerant to the whole refrigerant is high upstream of the heat exchange section 110, whereas the ratio of liquid refrigerant to the whole refrigerant increases as the refrigerant flows downstream. Thus, the volume of the refrigerant in each outflow path 122 is smaller than that in the corresponding inflow path 121.

Taking this into account, each inflow path 121 may be constituted by a larger number of heat-transfer pipes 112 than those constituting each outflow path 122.

With this configuration, when the heat exchanger 101 is used as a condenser, the area where gas refrigerant gives off heat is large, improving the heat-exchange efficiency.

That is, in the inflow paths and the outflow paths, it is desirable to select the number of heat-transfer pipes used in each outflow path and the number of folding back and the like, in accordance with the distribution of warm air speed and expected heat exchange state of refrigerant. Those numbers may not be necessarily the same between the inflow paths and the outflow paths.

Next, a description will be given of another embodiment of a method of evaluating the flow rate of the refrigerant circulating in the heat exchanger 101.

The heat exchanger 101 has the same configuration as that of the above-described embodiment. That is, the connection pipes 151 are configured to have a hydraulic diameter D [mm] falling within the range given by Inequality 4.

The present embodiment differs from the above-described embodiment in that the former defines a condition for gas-liquid two-phase refrigerant including mixed liquid refrigerant to flow upward in the connection pipes 151 in terms of a rated cooling capacity Q rather than a refrigerant circulation flow rate Gr in relation with the Froude number Fr.

The rated cooling capacity Q refers to an output of the air conditioner 1 when room air is cooled to a temperature of 27° C., under the condition where a temperature of outdoor air is 35° C. and a relative humidity of the room air is 45%.

As physical properties used for calculating the Froude number Fr vary per refrigerant to be used, the obtainable enthalpy difference and density change. For this reason, depending on the type of the refrigerant, gas-liquid two-phase refrigerant may possibly not flow upward in the connection pipe 151 even when the refrigerant circulation flow rate Gr derived from Froude number Fr falls within the range given by Inequality 3.

In view of this, the present evaluation method uses the rated cooling capacity Q [kW] as an index that substitutes for the refrigerant circulation flow rate Gr [kg/s].

Inequality 5 expresses a range corresponding to the range given by Inequality 3.

$$0.75 \leq Q/N \leq 3.5 \text{ [kW]} \qquad \text{Inequality 5}$$

Controlling the rated cooling capacity per path Q/N to fall within the range given by Inequality 5 achieves the same effects as those intended by Inequality 3, even with refrigerant having different physical properties.

That is, gas-liquid two-phase refrigerant is able to flow upward in the connection pipes 151 and formation of liquid pools in the connection pipes 151 can be inhibited.

Therefore, formation of liquid pools in the heat exchanger 101 can be inhibited and an appropriate amount of refrigerant can be sealed while improving the heat-exchange efficiency.

Reference Signs List

The invention claimed is:

1. An air conditioner, comprising:

a heat exchanger, which comprises:

a plurality of heat-transfer pipes arranged to extend in a horizontal direction and to be spaced apart at predetermined intervals in a vertical direction and configured to allow a thermal medium to flow therein, wherein the heat transfer pipes comprise a plurality of inflow paths into which the thermal medium flows from an outside of the heat exchanger and the heat transfer pipes comprise a plurality of outflow paths from which the thermal medium flows out to the outside of the heat exchanger; and a plurality of connection pipes including a first connection pipe and a second connection pipe, wherein an outlet side of a first inflow path, of the plurality of inflow paths, communicates with an inlet side of a first outflow path, of the plurality of outflow paths, via the first connection pipe, wherein the first outflow path is disposed below the first inflow path, wherein an outlet side of a second inflow path, of the plurality of inflow paths, communicates with an inlet side of a second outflow path, of the plurality of outflow paths, via a second connection pipe, wherein the second outflow path is disposed above the second inflow path, and wherein at least one connection pipes has a hydraulic diameter of 4 mm or greater.

2. The air conditioner of claim 1, wherein at least one of the plurality of connection pipes has a hydraulic diameter of 11 mm or less.

3. The air conditioner of claim 1, wherein each of the plurality of heat-transfer pipes is constituted by a tubular member with a cross section having a substantially oval shape, the tubular member having an interior divided into a plurality of flow channels extending in a length direction of the tubular member.

4. The air conditioner of claim 1, wherein the thermal medium comprises at least one of the group consisting of R410A, R404A, R32, R1234yf, R1234ze(E), and HFO1123.

5. A heat exchanger, comprising:

a plurality of heat-transfer pipes arranged to extend in a horizontal direction and to be spaced apart at predetermined intervals in a vertical direction and configured to allow a thermal medium to flow therein, wherein the heat transfer pipes comprise a plurality of inflow paths into which the thermal medium flows from an outside of the heat exchanger and the heat transfer pipes comprise a plurality of outflow paths from which the thermal medium flows out to the outside of the heat exchanger; and a plurality of connection pipes including a first connection pipe and a second connection pipe, wherein an outlet side of a first inflow path, of the plurality of inflow paths, communicates with an inlet side of a first outflow path, of the plurality of outflow paths, via the first connection pipe, wherein the first outflow path is disposed below the first inflow path, wherein an outlet side of a second inflow path, of the plurality of inflow paths, communicates with an inlet side of a second outflow path, of the plurality of outflow paths, via a second connection pipe, wherein the second outflow path is disposed above the second inflow path, and wherein at least one of the plurality of connection pipes has a hydraulic diameter of 4 mm or greater.

6. The heat exchanger of claim 5, wherein the at least one of the plurality of connection pipes has a hydraulic diameter of 11 mm or less.

7. The heat exchanger of claim 5, wherein each of the plurality of heat-transfer pipes is constituted by a tubular member with a cross section having a substantially oval shape, the tubular member having an interior divided into a plurality of flow channels extending in a length direction of the tubular member.

8. The heat exchanger of claim 5, wherein the thermal medium comprises at least one of the group consisting of R410A, R404A, R32, R1234yf, R1234ze(E), and HFO1123.

* * * * *